US006337966B1

(12) United States Patent
Yamamoto

(10) Patent No.: US 6,337,966 B1
(45) Date of Patent: Jan. 8, 2002

(54) DEVELOPING DEVICE WITH DEVELOPER CHARGING DEVICE

(75) Inventor: Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/232,700

(22) Filed: Jan. 19, 1999

(30) Foreign Application Priority Data

Jan. 20, 1998 (JP) ..... 10-022835

(51) Int. Cl.[7] ..... G03G 15/08
(52) U.S. Cl. ..... 399/281
(58) Field of Search ..... 399/265, 279, 399/281, 285, 272

(56) References Cited

U.S. PATENT DOCUMENTS 4,481,903 A * 11/1984 Haberhauer et al. ..... 399/281
4,743,937 A * 5/1988 Martin ..... 399/281
4,947,211 A * 8/1990 Ono et al. ..... 399/105
5,387,963 A * 2/1995 Kajimoto et al. ..... 399/284
5,424,817 A * 6/1995 Imamiya et al. ..... 399/281
5,594,198 A * 1/1997 Ikeda et al. ..... 399/281
5,754,929 A 5/1998 Nonomura et al. ..... 399/275
5,835,819 A 11/1998 Yamamoto ..... 399/51

FOREIGN PATENT DOCUMENTS

JP 58-116559 7/1919

* cited by examiner

*Primary Examiner*—Robert Beatty
(74) *Attorney, Agent, or Firm*—Fitzpatrick, Cella, Harper & Scinto

(57) ABSTRACT

A developing device has a developer bearing member for carrying a developer thereon and conveying it to an image bearing member, a developer supplying member for supplying the developer to the developer bearing member, and a charging member for effecting discharge by an electric field high enough to cause air to break down between itself and the developer supplying member to thereby charge the developer carried on the developer supplying member. The developer charged by the discharge effected between the developer supplying member and the charging member is supplied to the developer bearing member.

13 Claims, 6 Drawing Sheets

DEVELOPING DEVICE WITH DEVELOPER CHARGING DEVICE

BACKGROUND OF THE INVENTION

1. Field of the Invention

This invention relates to a developing device for use in an image forming apparatus such as an electrophotographic apparatus or an electrostatic recording apparatus.

2. Related Background Art

In an image forming apparatus utilizing an electrophotographic system, an electrostatic latent image is formed on an image bearing member and it is developed and visualized as a toner image, and the toner image is transferred onto a transfer material to thereby obtain an image.

As the above-described developing method, generally there are a one-component developing method using a one-component developer comprising only a magnetic toner, and a two-component developing method using a two-component developer comprising magnetic particles (magnetic carrier) and a toner. However, the one-component developing method has the merit that the construction of a developing device is simpler and the maintenance thereof is easy, and at present, various one-component developing devices based on this one-component developing method are proposed and put into practical use.

There is also proposed a developing method using a non-magnetic one-component developer comprising only a non-magnetic toner, as shown in Japanese Patent Laid-Open No. 58-116559, and in order to cope with the recent tendency toward the coloring of images, there is put into practical use a developing device which can provide colored images of high quality and which is moreover low in cost and compact.

As an example, a non-magnetic one-component developing device is shown in FIG. 7 of the accompanying drawings. In the developing device of FIG. 7, a cylindrical non-magnetic developing sleeve 1 rotatable in the direction of arrow is installed as a toner carrying member in a developing container 3 containing therein a non-magnetic toner which is a one-component developer, and a toner supplying and collecting roller 14 and a regulating blade 13 as a developer regulating member abut against the developing sleeve 1.

The toner supplying and collecting roller 14 comprises a mandrel 14*a* of SUS or like material and an elastic member 14*b* of urethane foam or like material formed on the outer peripheral surface of the mandrel 14*a*, and is rotated while frictionally contacting with the developing sleeve 1 to thereby supply the non-magnetic toner contained in the developing container 3 to the surface of the developing sleeve 1. Also, it has the action of scraping off any non-magnetic toner which has not contributed to the development in a developing portion opposed to a photosensitive drum, not shown, and has been returned into the developing container 3 with the rotation of the developing sleeve 1 from the surface of the developing sleeve 1.

The regulating blade 13 comprises a support member 13*a* formed of phosphor bronze or like material and attached to the developing container 3 and an elastic member 13*b* of urethane rubber or like material adhesively secured to the support member 13*a*, and the elastic member 13*b* elastically bears against the surface of the developing sleeve 1 to thereby regulate the toner born (carried) on the developing sleeve 1 and form it into a thin toner layer and also impart frictional charging charges to the toner.

By the above-described construction, the developing device can well form a thin layer of charged non-magnetic toner on the developing sleeve 1 and supply it for the development of an electrostatic latent image formed on the surface of the photosensitive drum and thus, the good development of the latent image has become possible.

In the above-described non-magnetic one-component developing device, however, the imparting of charges to the toner is effected by the frictional contact of the toner on the developing sleeve 1 with the regulating blade 13 or the developing sleeve 1 when it passes the regulating blade 13. Therefore, charges can be well imparted to the toner of the layer-like toner on the developing sleeve 1 which passes the vicinity of the regulating blade 13 and the developing sleeve 1, but it is difficult to impart sufficient charges to the toner present in the interior of the toner layer.

Therefore, in some cases, a bias occurs in the distribution of the charge amount in the thin toner layer formed on the developing sleeve 1 by regulation and thus, uncharged toner and reversed toner exist in the toner layer. The uncharged toner and reversed toner cause poor (bad) images such as fogged image.

To eliminate the uncharged toner and reversed toner and impart a predetermined or greater amount of charges to all the toner in the toner layer, it is necessary to make the pressure of contact of the regulating blade 13 with the developing sleeve 1 high, make the amount of toner passing there small and increase the chance of contact of the toner with the regulating blade 13 and the developing sleeve 1.

However, to form an image of sufficient density, a certain degree of toner amount is necessary and there is also a limit to making the toner layer thin by an increase in the pressure of contact of the regulating blade 13. An increase in the pressure of contact of the regulating blade 13 also leads to the problem that the mechanical load applied to the toner becomes very great.

Also, the toner supplying and collecting roller 14 bearing against the developing sleeve 1 frictionally contacts with the latter to thereby effect the supply of fresh toner to the developing sleeve 1 and the collection of any toner remaining after development and therefore, depending on the location of the toner supplying and collecting roller 14 and the direction of rotation of the roller 14, there has been a case where the toner remaining after development cannot be completely collected.

If the toner remaining after development is not collected but remains residual on the developing sleeve 1, the residual toner again passes between the regulating blade 13 and the developing sleeve 1 and is charged. When by this recharging, the toner receives excessive charges, the force with which the toner adheres to the developing sleeve 1 increases and therefore, it is difficult for the toner to separate from the developing sleeve 1 in the developing portion and the toner may sometimes be returned into the developing container 3 without being used for development.

If in such a manner, the toner remaining on the developing sleeve 1 after development after passes the toner supplying and collecting roller 14 and the regulating blade 13 while remaining restrained on the surface of the developing sleeve 1, the shape of the toner is gradually changed by a mechanical load received each time and the accumulation of heat generated at that time, and an extraneous additive or the like controlling the amount of charges and fluidity of the toner is buried into the toner and thus, the toner is deteriorated.

Such deteriorated toner cannot obtain a desired charging characteristic and fluidity, thus causing many problems during an image forming process.

When for example, the amount of the deteriorated toner increases on the developing sleeve 1, the supply of fresh toner may be hindered and the amount of toner on the developing sleeve 1 after regulation may decrease and the developing property of the toner may be reduced. Also, even if the once deteriorated toner is collected into the developing container 3 by the toner collecting roller and thereafter is again supplied to the developing sleeve 1, the desired charging characteristic and fluidity cannot be obtained and therefore, a good developing property is not obtained and further, poor (bad) transfer such as hollow characters is caused during transfer.

Further, when the deteriorated toner is fused on the surface of the contacting portion of the regulating blade 13 and the surface of the developing sleeve 1, a bad coat such as streaks occurs to the toner layer on the developing sleeve 1. Also, the imparting of charges to the toner newly supplied to the developing sleeve 1 is hampered and thus, uncharged toner may be conveyed to the developing portion to thereby cause a bad image such as fog and unevenness.

On the other hand, if the frictional contact of the toner supplying and collecting roller 14 with the developing sleeve 1 continues for a long time, the wear and injury of the roller 14 itself and the clogging or the like of the toner may occur and the role as the toner supplying and collecting roller 14 will become insufficient and the roller 14 may sometimes become incapable of effecting a good supply of toner.

As described above, the developing device using the non-magnetic toner is simple in construction and yet can effect good development, but lacks the durability and stability of the toner and the developing device and has only been utilized chiefly in developing devices of the cartridge type in which the developing device is bodily interchanged during the supply of a toner, and has not much adopted in developing devices of a type in which when necessary, a toner is supplied as in a copying apparatus.

SUMMARY OF THE INVENTION

It is an object of the present invention to provide a developing device which makes image formation of high dignity in which uncharged toner does not contribute to development possible.

It is another object of the present invention to provide a developing device in which a load applied to a toner during the supply of the toner to a developing sleeve and during the imparting of charges to the toner is remarkably reduced to thereby realize a low stress coat of toner and which is usable as a developing device of a toner supply type for a long period of time.

It is still another object of the present invention to provide a developing device comprising:

(a) a developer bearing member for bearing a developer thereon and conveying the developer to an image bearing member;

(b) a developer supplying member for supplying the developer to the developer bearing member; and (c) a charging member for discharging between the charging member and the developer supplying member to thereby charge the developer borne on the developer supplying member;

wherein the developer charged by discharging between the developer supplying member and the charging member is supplied to the developer bearing member.

Other objects and features of the present invention will become apparent from the following detailed description taken in conjunction with the accompanying drawings.

DESCRIPTION OF THE PREFERRED EMBODIMENTS

Some embodiments of the present invention will hereinafter be described with reference to the drawings.

Embodiment 1

Figure 1:
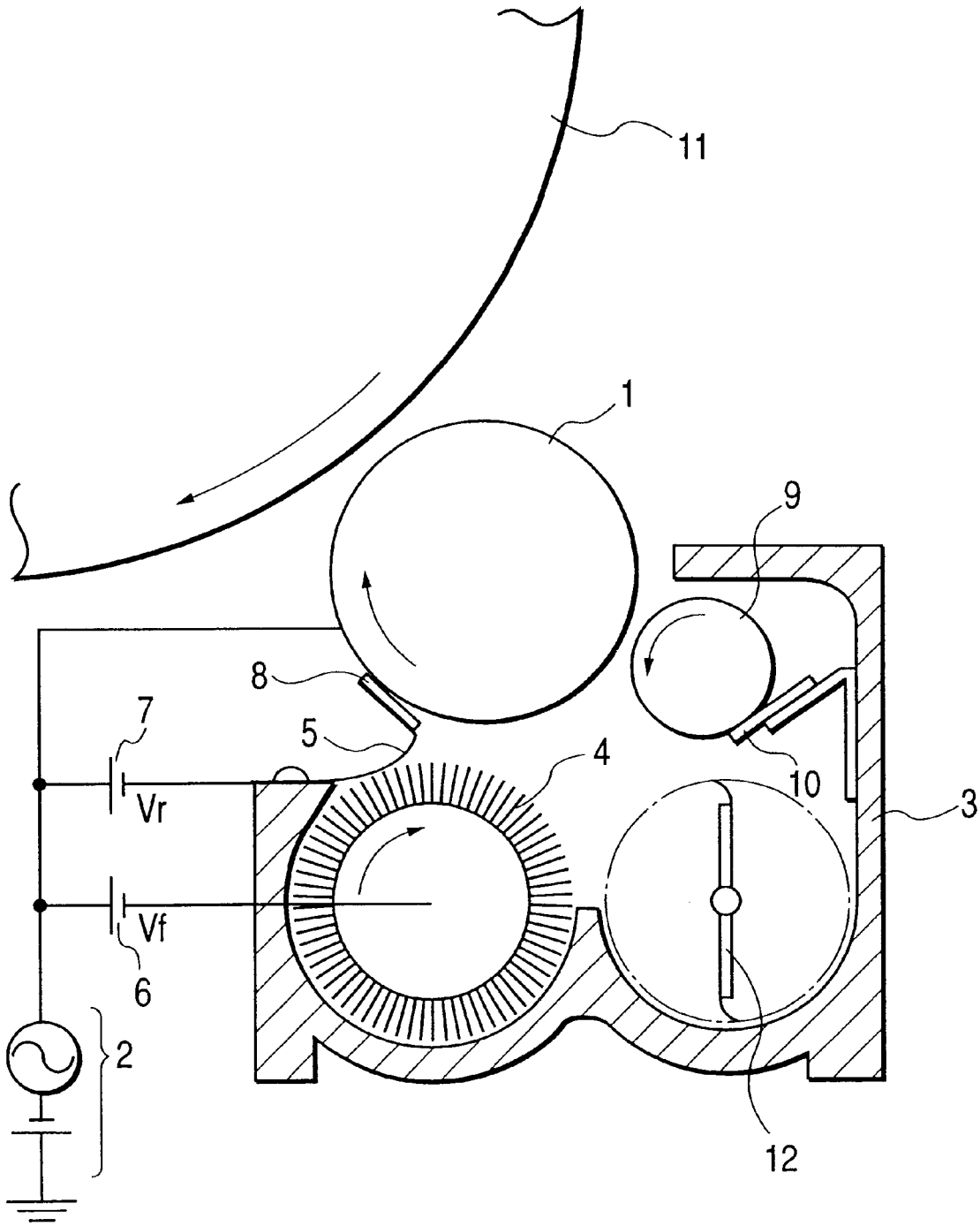
FIG. 1 is a cross-sectional view showing an embodiment of the developing device of the present invention.

FIG. 1 is a cross-sectional view showing an embodiment of the developing device of the present invention.

As shown in FIG. 1, the developing device of the present embodiment has a developing container 3 containing therein a non-magnetic toner which is a one-component developer, and is provided with a developing sleeve 1 as a developer bearing member rotatable in the direction of arrow in the opening portion of the developing device 3 which is opposed to a photosensitive drum 1. A developing bias comprising a DC voltage and an AC voltage superposed one upon the other may be applied from a power source 2 to the developing sleeve 1. A toner supplying brush 4, a toner charging member 5 and a toner regulating member (elastic blade) 8 are installed relative to the developing sleeve 1 and further, a toner collecting roller 9 is installed at the back side of the developing sleeve 1 as viewed from the opening portion of the developing container 3, and an agitating member 12 is installed below it. A scraper 10 bears against the toner collecting roller 9.

The toner supplying brush 4 is for supplying the non-magnetic toner contained in the developing container 3 to the developing sleeve 1, and is disposed at a distance of about 100 $\mu$m to 1 mm substantially below the developing sleeve 1 for rotation in the same direction as the direction of rotation of the developing sleeve 1 (the direction in which it is moved in the opposite direction at the most proximate portion to the developing sleeve 1). A power source 6 for applying a bias is connected to the mandrel of the brush 4, and a desired voltage comprising a developing bias and a DC voltage Vf superposed thereon is applied thereto.

In the present embodiment, the toner supplying brush 4 comprises a fur brush (brush roller) consisting of electrically conductive fiber having an electrical characteristic of medium resistance having volume resistivity of $10^6$ to $10^8$ Ωcm and wound on a mandrel of SUS or the like, and the flocking density of the electrically conductive fiber is 20,000 to 200,000/ inch$^2$, the thickness thereof is 1 to 10 denier/filament, the pile length thereof is 1 to 10 mm, and the fiber material used is nylon or rayon.

Figure 2:
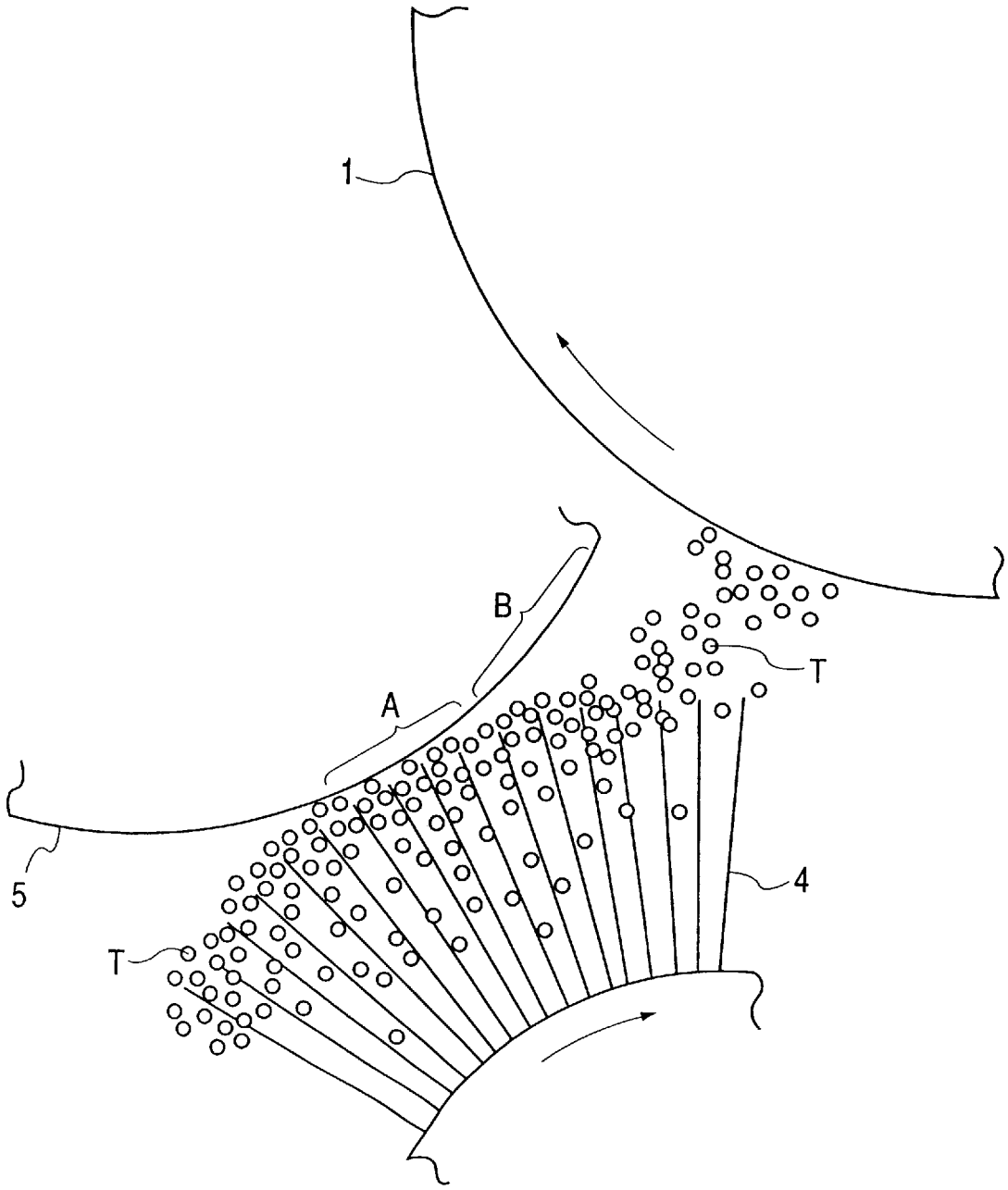
FIG. 2 is a detailed view showing a developer supplying portion in the developing device of FIG. 1.

The toner charging member 5 is provided in that portion of the developing container 3 which is below the developing sleeve 1 so as to partly contact with the toner supplying brush 4. The toner charging member 5, as shown in FIG. 2, comprises a thin plate having a curvature with which it bends to the opposite side from the toner supplying brush 4, and between the toner charging member 5 and the toner supplying brush 4, there is formed a spacing area B downstream of the contact area A therebetween with respect to the direction of rotation of the brush 4, the distance of the spacing area B becoming gradually greater toward the downstream side. A power source 7 is connected to the toner charging member 5, and a desired voltage comprising a developing bias and a DC voltage Vr superposed thereon is applied from the power source 7 to the toner charging member 5.

In the present embodiment, as the toner charging member 5, use is made of metallic foil of SUS or phosphor bronze having a thickness of 100 $\mu$m to 1 mm. The toner charging member 5 can be provided with a elastic rubber layer of EPDM, NBR or the like on that surface thereof which contacts with the toner supplying brush 4, and further thereon, there can be provided a urethane rubber layer in which carbon is dispersed to thereby regulate resistance to 105 Ωcm or less.

The toner regulating member, i.e., the elastic blade 8, is for regulating the layer thickness of the toner applied onto the developing sleeve 1, and is disposed at that end portion of the toner charging member 5 which is near the brush 4, and elastically bears against the developing sleeve 1. In the present embodiment, a rubber elastic material such as urethane rubber or silicone rubber of JIS hardness 50° to 70° is used for the elastic blade 8, and this blade bears against the developing sleeve 1 with line pressure of 5 to 50 g/cm.

The toner collecting roller 9 is for electrically stripping off any toner remaining on the developing sleeve 1 after development which has not contributed to development from the developing sleeve 1 and causing it to be carried on the developing sleeve to collect such toner into the developing container 3 and return it to the developing step, and is disposed at an interval of about 100 $\mu$m to 1 mm from the developing sleeve 1, and is rotated in the direction opposite to the direction of rotation of the developing sleeve 1 (the same direction in the most proximate portion).

In the present embodiment, as the toner collecting roller 9, use is made of a metallic cylinder having its surface formed into a mirror surface, but with the parting property thereof with respect to the toner stripped off from the developing sleeve 1 taken into account, a layer of fluorine resin such as Teflon can be provided on the surface of this toner collecting roller 9 with a thickness of the order of 2 $\mu$m to 50 $\mu$m. The addition of such a resin layer also has the action of performing the role of leak prevention when a very strong electric field is applied to between the developing sleeve 1 and the collecting roller 9.

The scraper 10 is for scraping the toner remaining after development stripped off from the developing sleeve 1 and carried on the collecting roller 9 from the surface of the collecting roller 9, and abuts against the surface of the lower portion of the collecting roller 9 so that the scraped toner may fall onto the agitating member 12.

The agitating member 12 for supplying the non-magnetic toner contained in the developing container 3 to the toner supplying brush 4 while agitating it by being rotated.

The non-magnetic toner used in the present embodiment is a coloring agent mixed with and dispersed in thermoplastic resin, and crushed so as to have a weight average particle diameter of 5 $\mu$m or larger, and polystyrene or polyester resin having a negative charging characteristic is used as the thermoplastic resin. The developing method is an image exposure-reverse developing system of a construction in which the surface of the photosensitive drum 11 is charged to the negative polarity by charging means, not shown, and image exposure is effected by exposure means, not shown, to thereby form an electrostatic latent image, and as a developing bias, a voltage comprising a DC voltage of the negative polarity and an AC voltage superposed one upon the other is applied to the developing sleeve 1 by the power source 2 to thereby cause the non-magnetic toner of the negative polarity to adhere (reversely develop) to the latent image (exposed portion).

Also, in the present embodiment, an OPC photosensitive member is used as the photosensitive drum 11, and a coat sleeve coated with resin composed of PMMA and dimethyl aminoethyl methacrylate mixed together at 9:1 is used as the developing sleeve 1.

The non-magnetic toner contained in the developing container 3 is conveyed to the toner supplying brush 4 while being agitated by the agitating member 12, and is further conveyed to the portion of contact with the toner charging member 5 by the mechanical conveying force of the brush 4 with the rotation of the brush 4.

Figure 3:
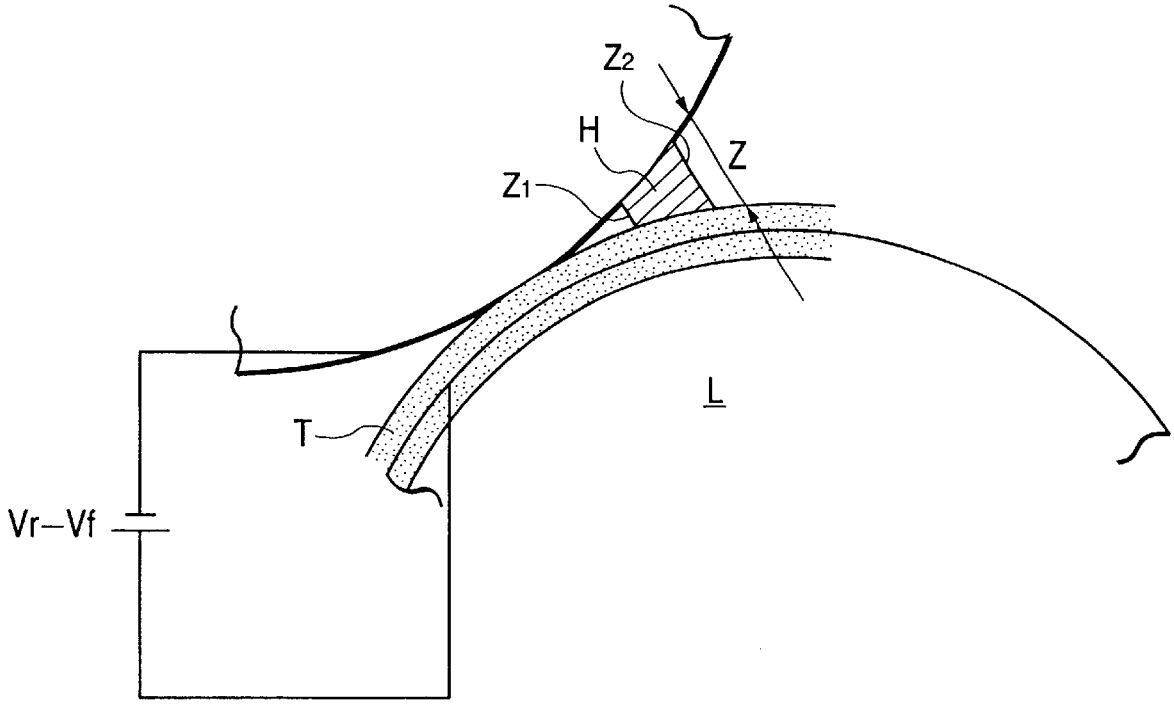
FIG. 3 is an illustration showing a discharging area in the developer supplying portion of FIG. 2.

This toner supplying brush 4, as shown in FIG. 2, contains a great deal of toner among the brush fibers and the outer peripheral portion thereof, and the toner T contained by this brush 4, when modelled, can be apparently regarded as forming a toner layer on the electrically conductive layer L of the brush 4, as shown in FIG. 3. In FIG. 3, the letter Z designates the distance between the toner charging member 5 and the surface of the toner layer.

Now, the toner T carried on the toner supplying brush 4 passes the contact area A with the charging member 5 and is conveyed to the spacing area B, but by the difference between the bias applied to the toner supplying brush 4 and the bias applied to the toner charging member 5, a voltage Vg shown by $$Vg=Z\ (Vr-Vf)/(\alpha+Z) \tag{1}$$

is applied to the spacing area B.

Here, Vf is the DC voltage of the power source 6 for the toner supplying brush 4, Vr is the DC voltage of the power source 7 for the toner charging member 5, and $\alpha$ is a value determined by the amount and dielectric constant of toner intervening between the toner supplying brush 4 and the toner charging member 5.

When this Vg exceeds a voltage Vp prescribed by the approximate expression of a discharge destroying voltage by Paschen's law, i.e., $$Vp=a+bZ,\ Z'8\ \mu m\ (a \text{ and } b \text{ are constants}), \tag{2}$$

discharge takes place.

Figure 4:
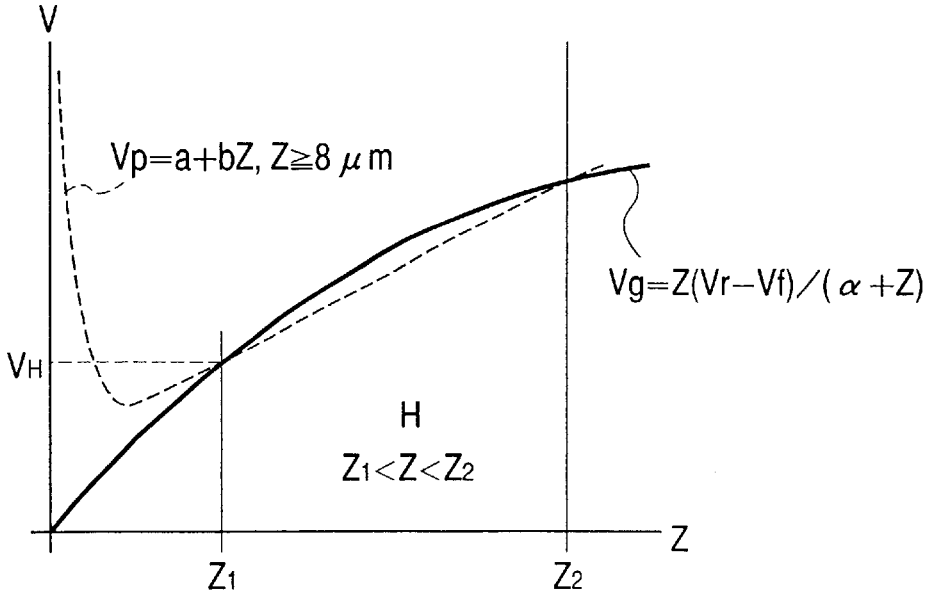
FIG. 4 is an illustration showing the condition of discharge in the discharging area of FIG. 3.

That is, a discharging area H is formed in an area of Z1 to Z2 (Vg>Vp) shown in FIG. 4. In FIG. 4, Vg when Z=Z1 is a so-called discharge starting voltage $V_H$.

When for example, Vr and Vf are set to −1.5 kV and −700V, respectively, and the amount of toner in the brush 4 is sortably set, sufficient discharge is effected between the toner supplying brush 4 and the toner charging member 5.

When in this manner, discharge occurs in the spacing area B, ions are produced and the thus produced ions adhere to the toner contained in the toner supplying brush 4 and therefore, the toner can be better charged.

Some of negative ions of the ions produced by discharge are attracted to the brush 4 side and adhere to the toner restrained by the brush 4. Excess negative ions are absorbed by the brush 4 itself and are cancelled. Positive ions produced simultaneously with the negative ions are electrically cancelled on the toner charging member 5 side.

Since fresh toner is sequentially supplied from the developing container 3 to the toner supplying brush 4 by the agitating member 12, it never happens that the brush 4 side is charged up, and discharge is always repeated in the above-described discharging area, i.e., the spacing area B. Also, in the contact area A between the toner supplying brush 4 and the toner charging member 5, the contact is that between the brush 4 and the metal forming the charging member 5 and therefore, the load applied to the toner T intervening between the brush 4 and the charging member 5 is very small.

In this manner, an appropriate amount of charge is imparted to the toner T contained in the toner supplying brush 4 by the frictional charging by the contact thereof with the brush fiber of the brush 4 and the adherence of ions by the discharge in the spacing area B, whereafter the toner T is conveyed to the most proximate portion between the developing sleeve 1 and the brush 4 downstream of the spacing area B with respect to the direction of rotation of the brush 4. In the most proximate portion, by the potential difference between the DC voltages of the bias applied to the developing sleeve 1 and the bias applied to the brush 4, the toner is attracted from the toner supplying brush 4 to the surface of the developing sleeve 1, and is supplied to the developing sleeve 1.

When for example, in contrast with the DC voltage Vf=−700V of the toner supplying brush 4, the DC voltage of the developing bias is set to −350V, the toner charged to the negative flies from the toner supplying brush 4 to the developing sleeve 1 by the action of an electric field by the contrast of the difference −350V therebetween. Of course, this applied voltage is determined by the kind of the toner, the distance between the brush 4 and the developing sleeve 1 and the peripheral speeds of the brush 4 and the developing sleeve 1, and these amounts are determined so that the toner having a proper amount of charge can be supplied in a desired quantity.

The toner supplied onto the developing sleeve 1 is carried on the surface thereof by a mirroring force, and is conveyed to the elastic blade 8 which is a toner regulating member, and is again regulated by the elastic blade 8 so as to become a thin and fine toner layer having a more uniform charge amount distribution.

In Embodiment 1, as described above, the toner is sufficiently charged in advance, whereafter the toner is supplied onto the developing sleeve 1 without contact and therefore, mechanical stress to the toner can be remarkably reduced. Further, only the sufficiently charged toner can be supplied onto the developing sleeve 1 and therefore, a reversed component becomes almost null in the charge amount distribution in the toner layer and it becomes possible to obtain images of high quality free of fog or the like.

The toner which has passed the elastic blade 8 shifts to and develops the electrostatic latent image on the photosensitive drum 11 in conformity with the latent image in the portion opposed to the photosensitive drum 11, and a toner image thus obtained is conveyed to a transferring portion, not shown, with the rotation of the photosensitive drum 11, and is transferred onto a transfer material such as paper.

On the other hand, the toner returned into the developing container 15 while being carried on the developing sleeve 1 without contributing to development is stripped off from the developing sleeve 1 by a strong electric field formed in the most proximate portion between the collecting roller 9 and the developing sleeve 1, and is carried and collected on the surface of the collecting roller 9. The borne toner is scraped off by the scraper disposed so as to contact with the surface of the collecting roller 9, and is again returned to the developing step.

As described above, the rotatable cylindrical roller 9 is used as a developer collecting member, whereby a fresh electrode surface is always opposed to the surface of the developing sleeve 1 and a stable electric field is normally formed between the developing sleeve 1 and the roller 9 and thus, the collection efficiency of the toner from the developing sleeve 1 is nearly 100%.

Embodiment 2

Figure 5:
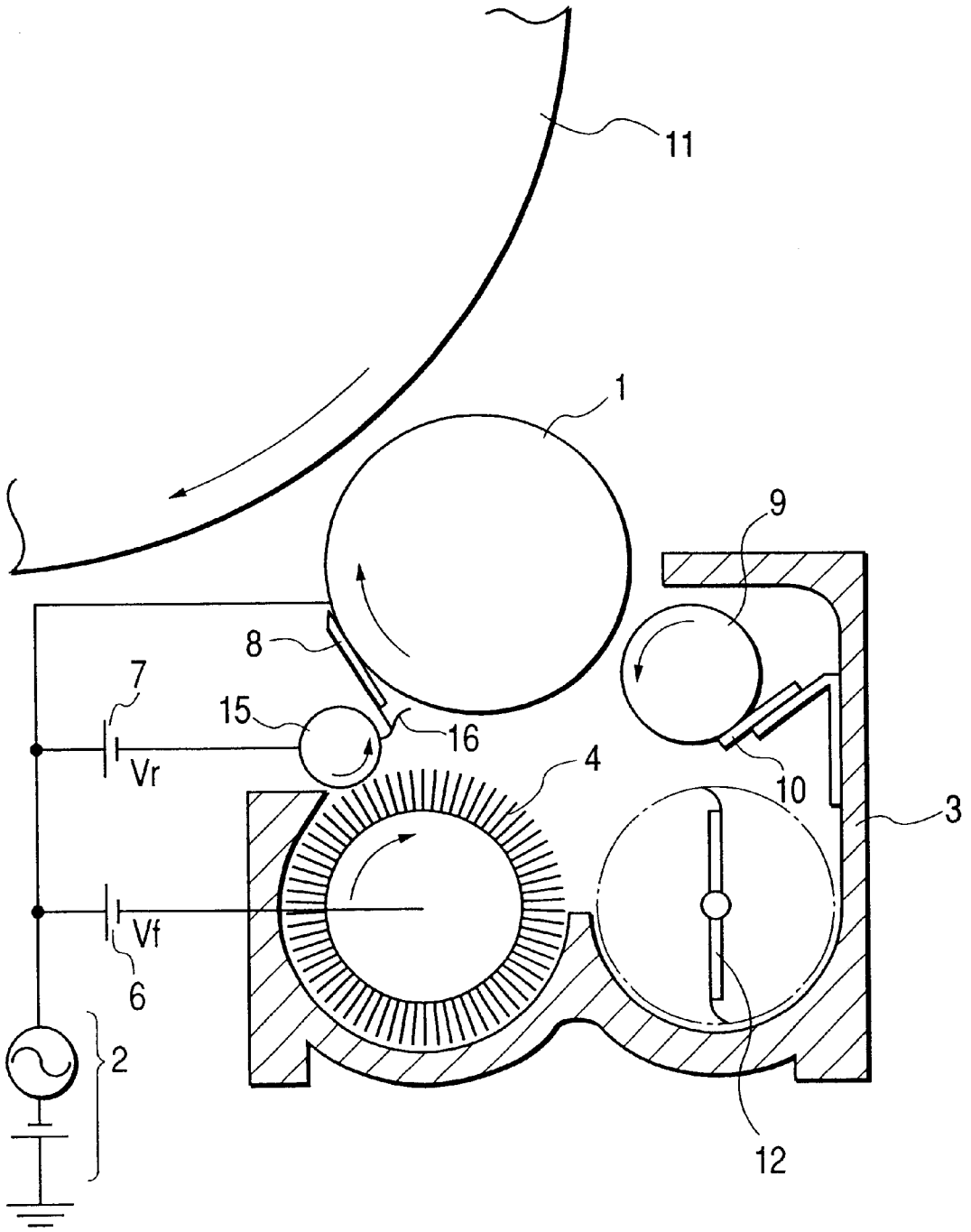
FIG. 5 is a cross-sectional view showing another embodiment of the developing device of the present invention.

FIG. 5 is a cross-sectional view showing another embodiment of the developing device of the present invention.

The toner charging member used in the present embodiment is not limited to the plate-like charging member in Embodiment 1 shown in FIG. 1, but a roller-like charging member 15 as shown, for example, in FIG. 5 can be used to obtain an effect equal to or greater than that of the plate-like charging member.

According to the toner charging member 8 in Embodiment 1, there are not a few cases where the reversed toner or the like adheres to the surface facing the spacing area B formed between the toner supplying brush 4 and the toner charging member to thereby binder the discharge.

So, in the present embodiment, the roller-like charging member, i.e., the charging roller 15, is brought into contact with the toner supplying brush 4, and this is used while being rotated as indicated by the arrow in FIG. 5, and further a scraper 16 is disposed so as to be in contact with the surface of the charging roller 15, thereby scraping off the toner adhering to the surface.

While in the present embodiment, a metallic cylinder is used as the charging roller 15, an elastic rubber layer of EPDM, NBR rubber or the like can be provided on the surface of the charging roller 15, as in the charging member 8 in Embodiment 1, and further a urethane rubber layer having carbon dispersed therein can be provided on the peripheral surface thereof.

According to the present embodiment, the charging roller 15 is used as the toner charging member and the scraper 16 is brought into contact with the surface of the charging roller 15. Therefore, the stains on the surface of the toner charging member which forms the area of contact with the toner supplying brush 4 and the surface forming the spacing area (i.e., the discharging surface) can be removed and the imparting of charges to the toner by stable discharge can always be effected.

Accordingly, as in Embodiment 1, the mechanical stress to the toner can be remarkably reduced and moreover, only the sufficiently charged toner can be more stably supplied onto the developing sleeve 1, and images of more improved quality can be obtained.

Embodiment 3

Figure 6:
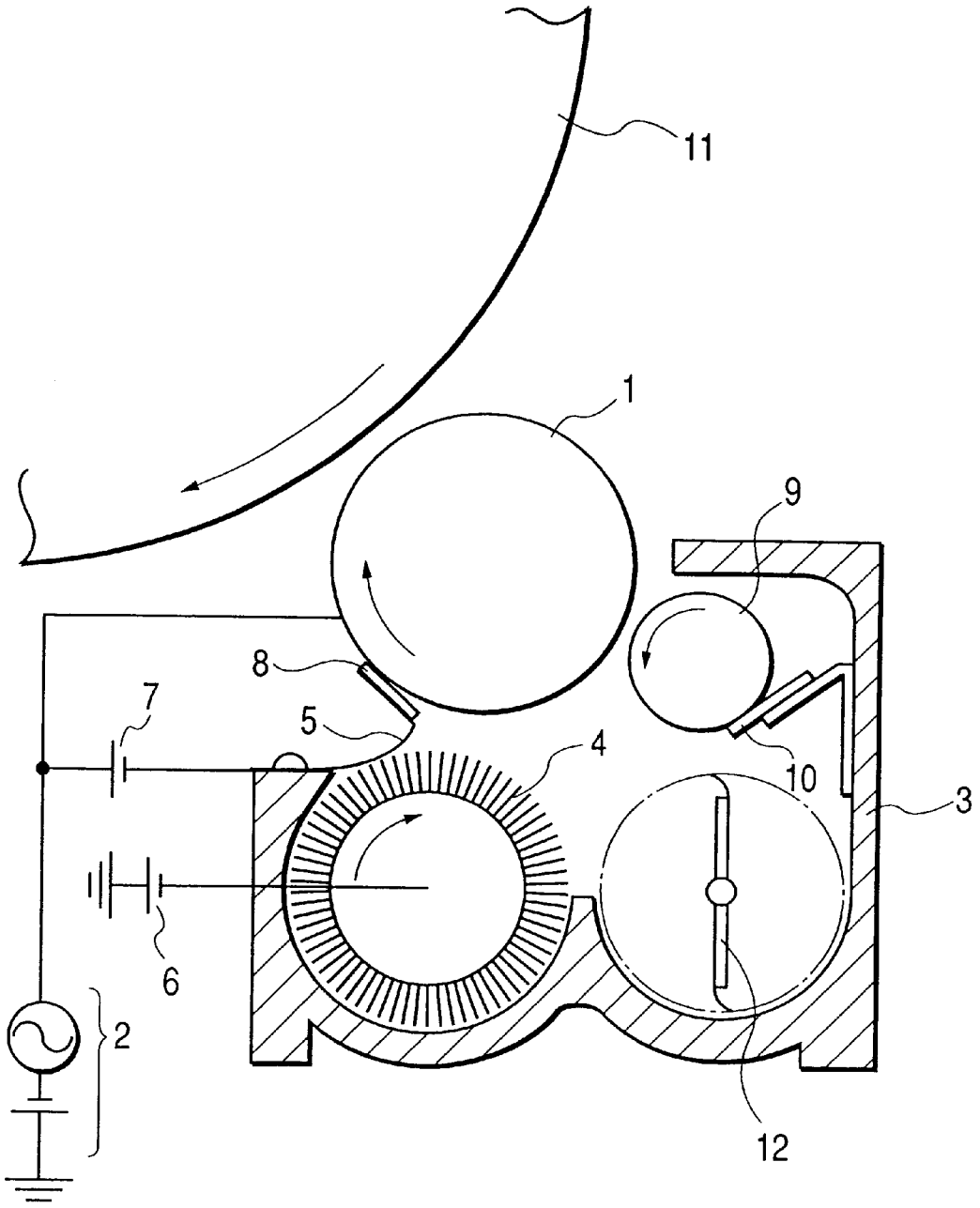
FIG. 6 is a cross-sectional view showing still another embodiment of the developing device of the present invention.
Figure 7:
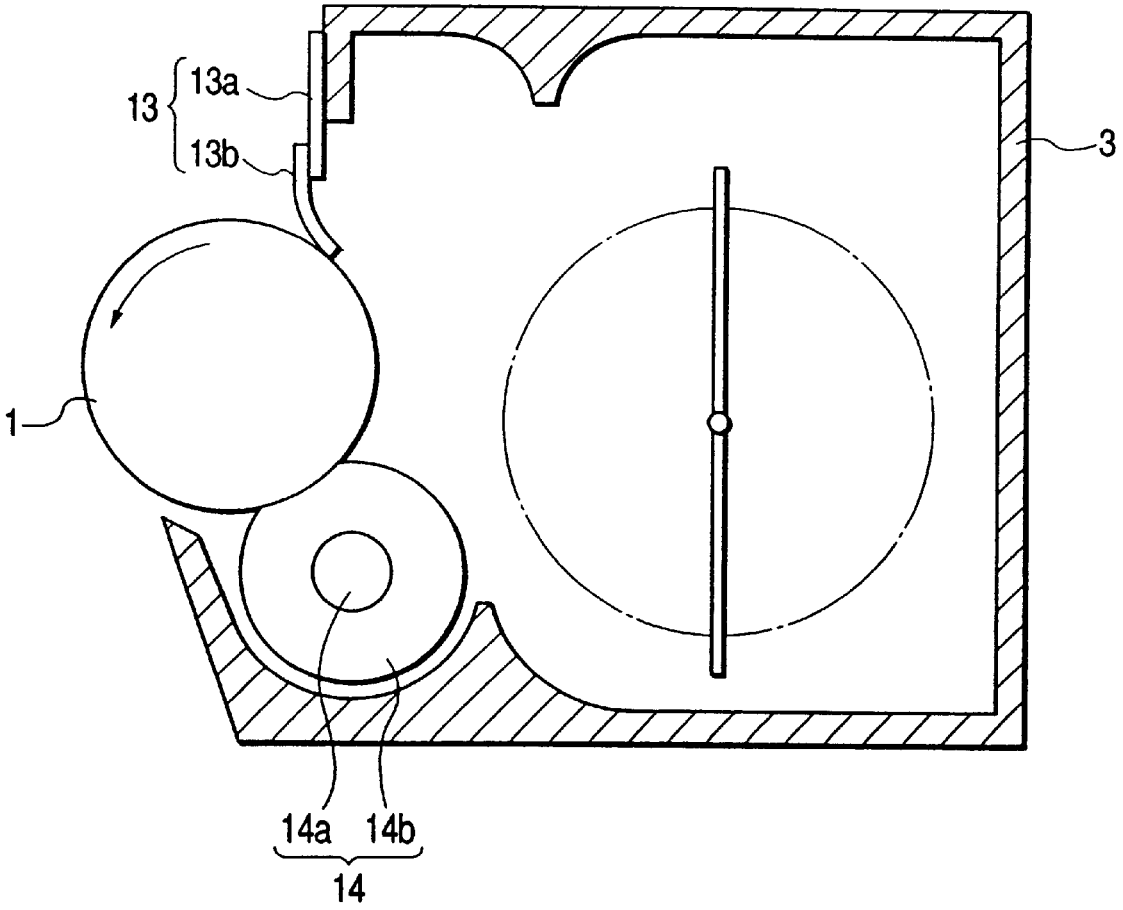
FIG. 7 PRIOR ART
FIG. 7 is a cross-sectional view showing a developing device.

FIG. 6 is a cross-sectional view showing still another embodiment of the developing device of the present invention.

This embodiment is characterized in that as shown in FIG. 6, the power source 6 of the toner supplying brush 4 applies only a DC voltage Vf to the supplying brush 4.

In Embodiment 1, a voltage comprising an AC voltage and a DC voltage superposed one upon the other is applied to the supplying brush 4 by the power source 6, but if as in the present embodiment, only the DC voltage Vf is applied, there is obtained an effect equal to or greater than that of Embodiment 1.

When for example, as a developing bias, use is made of a voltage comprising a DC voltage of −350V superposed on an AC voltage of peak-to-peak voltage $V_{pp}$=1.8 kV and a frequency f=2.0 kHz, if a DC voltage Vr applied to the charging member 5 by the power source 7 is −1.5 kV, a voltage comprising a DC voltage of −1.85 kV superposed on an AC voltage of $V_{PP}$=1.8 kV and f=2.0 kHz is applied to the charging member 5. Thus, if only a DC voltage Vf=−700V is applied to the supplying brush 4, an alternating electric field is formed in the spacing area B.

As described above, in the present embodiment, an alternating electric field is formed in the spacing area B and therefore, the discharge in the spacing area B can be more stabilized and uniform and irregularity-free (even) charging of the toner becomes possible.

As described above, according to Embodiments 1 to 3, only the toner sufficiently charged without contact can be supplied to the developer bearing member without the use of the contact type developer supplying member used in the non-magnetic one-component developing method. As the result, the bias of the charge amount distribution can be eliminated in the toner layer formed on the developer bearing member and the fog and unevenness during development or the scattering or the like during transfer decreases, and it becomes possible to obtain images of good quality.

Also, since the supply and collection of the toner are effected without contact each time the developer bearing member makes one full rotation, the load applied to the toner is reduced and the life of the toner is greatly improved and also, the life of the developing device itself can also be extended, and the developing device of the present invention becomes usable also as a developing device of the type which is installed in a copying apparatus or the like and replenishes the apparatus with a developer. Further, no hysteresis of development is left in the toner layer coating the developer bearing member and therefore, there is no ghost of image and in this sense as well, it has become possible to obtain images of high quality.

What is claimed is:

1. A developing device comprising:

a developer bearing member for bearing a developer thereon and applying the developer to an image bearing member;

a developer supplying member for supplying the developer to said developer bearing member at a developer supplying position;

a charging member for charging the developer in the vicinity of the developer supplying position; and electric field forming means for forming an electric field which is sufficiently high to cause air to break down and discharge between said charging member and said developer supplying member;

wherein the developer charged by discharging between said developer supplying member and said charging member is supplied to said developer bearing member.

2. A developing device according to claim 1, wherein said charging member has a contact portion which is in contact with said developer supplying member, and a spaced-apart portion spaced apart from said developer supplying member, and discharge is effected between said spaced-apart portion and said developer supplying member.

3. A developing device according to claim 2, wherein said contact portion is provided upstream of said spaced-apart portion with respect to a rotating direction of said developer supplying member.

4. A developing device according to claim 1, wherein said charging member comprises a thin plate.

5. A developing device according to claim 1, wherein said charging member comprises a roller.

6. A developing device according to claim 5, further comprising a scraper contacting with said roller.

7. A developing device according to claim 1, wherein a voltage comprising a DC voltage superposed on a voltage applied to said developer bearing member is applied to said charging member.

8. A developing device according to claim 1, wherein said developer supplying member is not in contact with said developer bearing member, and the developer charged by the discharge effected between said developer supplying member and said charging member is supplied to said developer bearing member by an electric field formed between said developer bearing member and said developer supplying member.

9. A developing device according to claim 8, wherein said developer supplying member comprises a brush roller.

10. A developing device according to claim 1, wherein a voltage comprising a DC voltage superposed on a voltage applied to said developer bearing member is applied to said developer supplying member.

11. A developing device according to claim 1, wherein only a DC voltage is applied to said developer supplying member.

12. A developing device according to claim 1, further comprising a collecting member for collecting the developer borne on said developer bearing member, which has not contributed to development, said collecting member not being in contact with said developing bearing member, and being adapted to electrically strip off the developer borne on said developer supplying member.

13. A developing device according to claim 1, wherein the developer comprises a nonmagnetic one-component developer.

* * * * *

UNITED STATES PATENT AND TRADEMARK OFFICE

CERTIFICATE OF CORRECTION

PATENT NO. : 6,337,966 B1
DATED : January 8, 2002
INVENTOR(S) : Takeshi Yamamoto It is certified that error appears in the above-identified patent and that said Letters Patent is hereby corrected as shown below:

Column 1,
Line 65, "born" should read -- borne --.

Column 2,
Line 56, after (second occurrence) should read -- then --.

Column 3,
Line 41, "dignity" should read -- quality --.

Column 5,
Line 53, "development" should read -- the developer has been --; and
Line 58, "for supplying" should read -- functions to supply --.

Column 6,
Line 56, "sortably" should read -- suitably --.

Column 8,
Line 23, "binder" should read -- hinder --.

Signed and Sealed this

Twenty-third Day of July, 2002

*Attest:*

*Attesting Officer*

JAMES E. ROGAN
*Director of the United States Patent and Trademark Office*